US011024984B2

(12) United States Patent
Blumenshein et al.

(10) Patent No.: US 11,024,984 B2
(45) Date of Patent: Jun. 1, 2021

(54) CONTACT CARRIER, ELECTRICAL CONTACT UNIT AND A METHOD OF PRODUCING A CABLE ASSEMBLY

(71) Applicant: TE Connectivity Germany GmbH, Bensheim (DE)

(72) Inventors: Rudi Blumenshein, Ellwangen (DE); Martin Huber, Dinkelsbuehl (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/923,616

(22) Filed: Mar. 16, 2018

(65) Prior Publication Data

US 2018/0269598 A1 Sep. 20, 2018

(30) Foreign Application Priority Data

Mar. 16, 2017 (DE) ..... 10 2017 105 682.3

(51) Int. Cl.
*H01R 9/03* (2006.01)
*H01R 4/18* (2006.01)
(Continued)

(52) U.S. Cl.
CPC ..... *H01R 4/186* (2013.01); *H01R 4/183* (2013.01); *H01R 4/70* (2013.01);
(Continued)

(58) Field of Classification Search
CPC .. H01R 4/2495; H01R 12/68; H01R 2103/00; H01R 13/658; H01R 4/185; H01R 4/20; H01R 43/048; H01R 4/18; H01R 4/183; H01R 4/188; H01R 4/203; H01R 9/05; H01R 9/0518; H01R 13/6582; H01R 13/659; H01R 13/6591; H01R 13/65914;
(Continued)

(56) References Cited

U.S. PATENT DOCUMENTS 3,157,448 A * 11/1964 Crimmins ..... H01R 13/28 439/295
3,715,457 A 2/1973 Teagno et al.
(Continued)

FOREIGN PATENT DOCUMENTS

CN 101740881 6/2010
CN 101740882 A 6/2010
(Continued)

OTHER PUBLICATIONS

German Patent Communication, dated Sep. 19, 2017, 10 pages.
(Continued)

*Primary Examiner* — Thanh Tam T Le
(74) *Attorney, Agent, or Firm* — Barley Snyder

(57) ABSTRACT

A contact carrier for an electrical contact device comprises a contact carrier body and a contact element disposed in the contact carrier body. The contact carrier body has a connecting section and a conductor clamping section. The conductor clamping section is substantially closed in a circumferential direction of the contact carrier body and extends along a longitudinal direction of the contact carrier body. The contact element has a contact section extending from the connecting section for contacting a mating contact element.

17 Claims, 8 Drawing Sheets

(51) Int. Cl.

| | |
|---|---|
| ***H01R 13/6591*** | (2011.01) |
| ***H01R 4/70*** | (2006.01) |
| ***H01R 43/048*** | (2006.01) |
| *H01R 13/6593* | (2011.01) |
| *H01R 9/05* | (2006.01) |
| *H01R 4/20* | (2006.01) |
| *H01R 13/6582* | (2011.01) |

(52) U.S. Cl.
CPC ..... *H01R 13/65914* (2020.08); *H01R 43/048* (2013.01); *H01R 4/20* (2013.01); *H01R 9/0518* (2013.01); *H01R 13/6582* (2013.01); *H01R 13/6593* (2013.01)

(58) Field of Classification Search
CPC ... H01R 13/65918; H01R 24/38; H01R 24/40
USPC .. 439/421–423, 579, 581, 607.48, 877, 879; 29/863
See application file for complete search history.

(56) References Cited

U.S. PATENT DOCUMENTS

| | | | | | |
|---|---|---|---|---|---|
| 4,153,326 | A * | 5/1979 | Frantz | H01R 13/28 | 439/293 |
| 4,537,456 | A * | 8/1985 | Brown | H01R 4/2466 | 439/404 |
| 4,618,202 | A * | 10/1986 | Libregts | H01R 13/582 | 439/425 |
| 4,621,887 | A * | 11/1986 | Piscitelli | H01R 13/111 | 439/843 |
| 5,153,988 | A * | 10/1992 | Mattis | H01R 4/2454 | 174/76 |
| 5,273,459 | A * | 12/1993 | Davis | H01R 13/6593 | 439/607.48 |
| 5,308,258 | A * | 5/1994 | Hatsios | H01R 13/28 | 439/284 |
| 5,462,451 | A * | 10/1995 | Yeh | H01R 12/7023 | 439/493 |
| 5,499,448 | A * | 3/1996 | Tournier | H01R 4/183 | 29/862 |
| 5,593,311 | A * | 1/1997 | Lybrand | H01R 13/6586 | 439/188 |
| 5,879,196 | A * | 3/1999 | Lee | H01R 13/504 | 439/604 |
| 6,077,122 | A * | 6/2000 | Elkhatib | H01R 13/5804 | 439/417 |
| 6,287,149 | B1 * | 9/2001 | Elkhatib | H01R 13/5804 | 439/417 |
| 6,702,617 | B1 * | 3/2004 | Clement | H01R 9/035 | 439/607.08 |
| 6,780,054 | B2 * | 8/2004 | Yip | H01R 12/592 | 439/101 |
| 6,884,115 | B2 * | 4/2005 | Malloy | H01R 9/0521 | 439/584 |
| 7,238,043 | B2 * | 7/2007 | Reibke | H01R 4/4827 | 439/441 |
| 7,572,148 | B1 * | 8/2009 | Pepe | H01R 13/514 | 439/607.05 |
| 7,611,392 | B2 * | 11/2009 | Osborn, Jr. | H01R 4/185 | 29/874 |
| 7,993,156 | B2 * | 8/2011 | Holste | H01R 4/4836 | 439/441 |
| 8,430,674 | B2 * | 4/2013 | Richard | H01R 4/4827 | 439/44 |
| 8,870,596 | B2 * | 10/2014 | Ii | H01R 13/6581 | 439/607.41 |
| 8,888,533 | B2 * | 11/2014 | Westman | H01R 13/514 | 439/626 |
| 8,992,257 | B2 * | 3/2015 | Ii | H01R 13/59 | 439/607.41 |
| 9,236,666 | B2 | 1/2016 | Matsushita | | |
| 9,748,674 | B2 * | 8/2017 | Xu | H01R 4/4836 | |
| 2002/0155757 | A1 * | 10/2002 | Yoshioka | H01R 9/034 | 439/607.01 |
| 2004/0038591 | A1 | 2/2004 | Clement et al. | | |
| 2014/0051295 | A1 | 2/2014 | Westman et al. | | |
| 2014/0060882 | A1 | 3/2014 | Ellis et al. | | |
| 2014/0134873 | A1 | 5/2014 | Lehmann | | |
| 2014/0190743 | A1 | 7/2014 | Matsushita | | |

FOREIGN PATENT DOCUMENTS

| | | | |
|---|---|---|---|
| CN | 104067446 | A | 9/2014 |
| DE | 10 2013 206 849 | A1 | 10/2014 |
| EP | 0590667 | A1 | 4/1994 |
| WO | 2014028224 | A1 | 2/2014 |
| WO | 2014035678 | A1 | 3/2014 |

OTHER PUBLICATIONS

Abstract of DE 10 2013 206 849, dated Oct. 16, 2014, 1 page.
European Patent Office Communication, dated Aug. 3, 2020, 6 pages.
Abstract of CN101740881(A), dated Jun. 16, 2010, 1 pp.
Abstract of EP0590667(A1), dated Apr. 6, 1994, 1 pp.
The First Office Action from the CNIPA dated Oct. 22, 2020, in Appln. No. 201810217564.9, and English translation thereof, 23 pp.
Abstract of CN104067446(A), dated Sep. 24, 2014, 1 pp.
Abstract of CN101740882(A), dated Jun. 16, 2010, 1 pp.
Abstract of WO2014028224(A1), dated Feb. 20, 2014, 1 pp.

* cited by examiner

CONTACT CARRIER, ELECTRICAL CONTACT UNIT AND A METHOD OF PRODUCING A CABLE ASSEMBLY

CROSS-REFERENCE TO RELATED APPLICATION

This application claims the benefit of the filing date under 35 U.S.C. § 119(a)-(d) of German Patent Application No. 102017105682.3, filed on Mar. 16, 2017.

FIELD OF THE INVENTION

The present invention relates to a contact carrier and, more particularly, to a contact carrier of an electrical contact unit.

BACKGROUND

A large number of electrical connectors are known which transmit electrical currents, voltages, signals and/or data with a large range of currents, voltages, frequencies and/or data rates. In the low, middle or high voltage and/or current ranges, and especially in the automotive industry, such connectors must ensure permanently, repeatedly and/or after a comparatively long service life a transmission of electrical power, signals and/or data without delay in adverse conditions. These adverse conditions can include warm, possibly hot, polluted, humid and/or chemically aggressive environments. Due to a wide range of applications, a large number of specially configured connectors are known.

The connector or housing of the connector can be installed on an electrical cable, a conductor, or a cable harness as a cable assembly. The connector or housing can alternatively be installed at an electrical unit or device such as a leadframe or a printed circuit board of an electronic component or mating connector. A connector disposed on a cable is commonly referred to as a plug connector and a connector disposed on an electrical component is a receptacle or socket connector.

Connectors corresponding to one another (connectors and mating connectors) usually have fastening or locking arrangements for long-term but releasable fastening or locking of the connector to the mating connector. Corresponding electrical contact elements or terminals must be securely received in the connector. Since the housings of the connectors are usually subject to a certain standardization, such as, for example, the FAKRA standard or a different standard, the most important dimensions of the housings have the same dimensions across different manufacturers.

Efforts are made to improve the cost-effective production of connectors, contact devices, and cable assemblies. In the prior art, two different kinds of joining methods, such as adhesive, soldering, or welding and crimping must be applied successively for producing an electrical cable assembly.

A two-pole electrical contact unit 80 according to the prior art is shown in FIGS. 1 and 2. The two-pole electrical contact unit 80 has a contact carrier 81 and an electrical shield contact device 82. The contact carrier 81 includes a contact carrier body 100, at or in which two electrical contact elements 190 or terminals 190 are embedded. The contact carrier body 100 is integrally formed and includes a connecting section 110, a positioning section 120 or transition section 120, and a conductor mounting section 180.

The contact elements 190, as shown in FIGS. 1 and 2, extend from the connecting section 110, in which they comprise contact sections 191, through the positioning section 120 into the conductor mounting section 180, in which they comprise cable contact sections. The contact sections 191 are formed as spring contacts or tongue contacts and contact a mating contact element. Other types of contact sections 191 such as, for example, a pin contact, peg contact, tab contact, socket contact or hybrid contact are also possible. The cable contact sections are formed as adhesive, solderable, or weldable cable contact sections.

In order to connect the cable contact sections which are embedded in the contact carrier body 100 to stripped longitudinal end sections 433 of two inner conductors 430 of a coaxial cable 40 in an electrically conductive and mechanically fixed manner, the longitudinal end sections 433 of the coaxial cable 40 are adhered, soldered or welded to the mechanical cable contact sections. The conductor mounting section 180 is accessible from the outside, i.e. upwardly open, and the longitudinal end sections 433 of the coaxial cable 40 are inserted in a vertical direction H into the conductor mounting section 180. The longitudinal end sections 433 of the coaxial cable 40 are then adhered, soldered or welded to the cable contact sections.

The contact carrier 81 with the coaxial cable 40 which is fastened thereon can be disposed in a contact carrier receptacle 200 of the shield contact device 82 as shown in FIG. 2. The contact carrier receptacle 200 has at least one electrical contact device 202, e.g. a contact spring 202 or a contact segment 202 for a mating contact unit, and a coding device 204.

The shield contact device 82 is crimped onto the coaxial cable 40. The shield contact device 82, as shown in FIGS. 1 and 2, has a cover section 280 with two cover wings 282, a shield crimping section 240 with two crimp flanks 242 and an insulation crimping section 250 with two crimp terminals 252. During crimping, the cover wings 282 are bent on the cover section and close the upwardly open conductor mounting section 180; an outer conductor crimp and an insulation crimp are further established at the shield crimping section 240 and the insulation crimping section 250 as shown in FIG. 2.

Particularly in the automotive industry, simple, fast and mass-producible joining of cables to contact devices and/or contact units is desirable for an on-board electrical system which includes all electrical and electronic components in vehicles. The current two-part joining methods of electrical connectors and electrical cable assemblies are inefficient and not cost-effective.

SUMMARY

A contact carrier for an electrical contact device comprises a contact carrier body and a contact element disposed in the contact carrier body. The contact carrier body has a connecting section and a conductor clamping section. The conductor clamping section is substantially closed in a circumferential direction of the contact carrier body and extends along a longitudinal direction of the contact carrier body. The contact element has a contact section extending from the connecting section for contacting a mating contact element.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
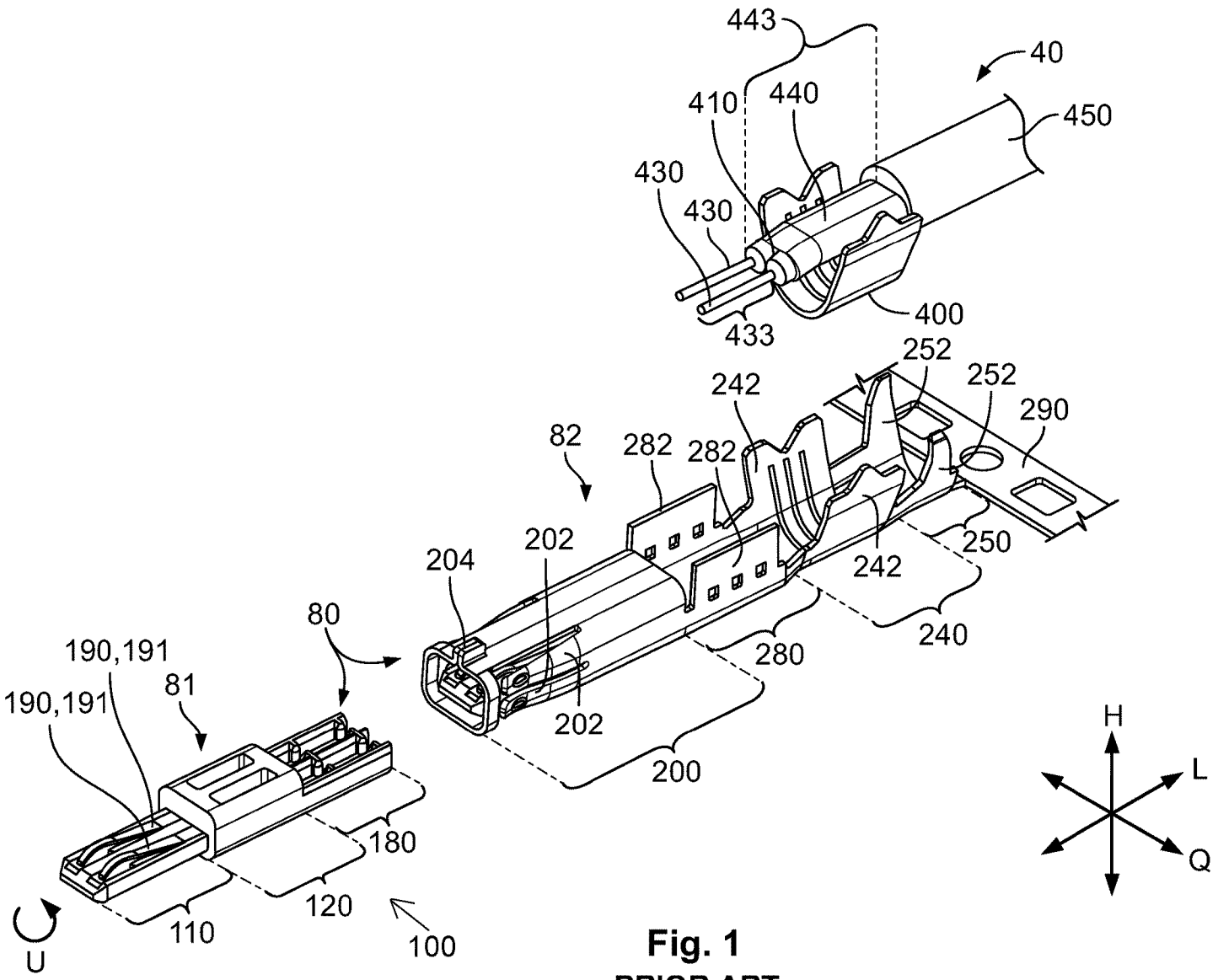
Fig. 1 PRIOR ART
FIG. 1 is an exploded perspective view of an electrical contact unit according to the prior art with a coaxial cable.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

The following description relates to a crimp contact unit 10 according to the invention being depicted using different features to the prior art mentioned above. Like reference numbers refer to like elements and only the differences from the prior art shown in FIGS. 1 and 2 will be described in detail herein.

Figure 3:
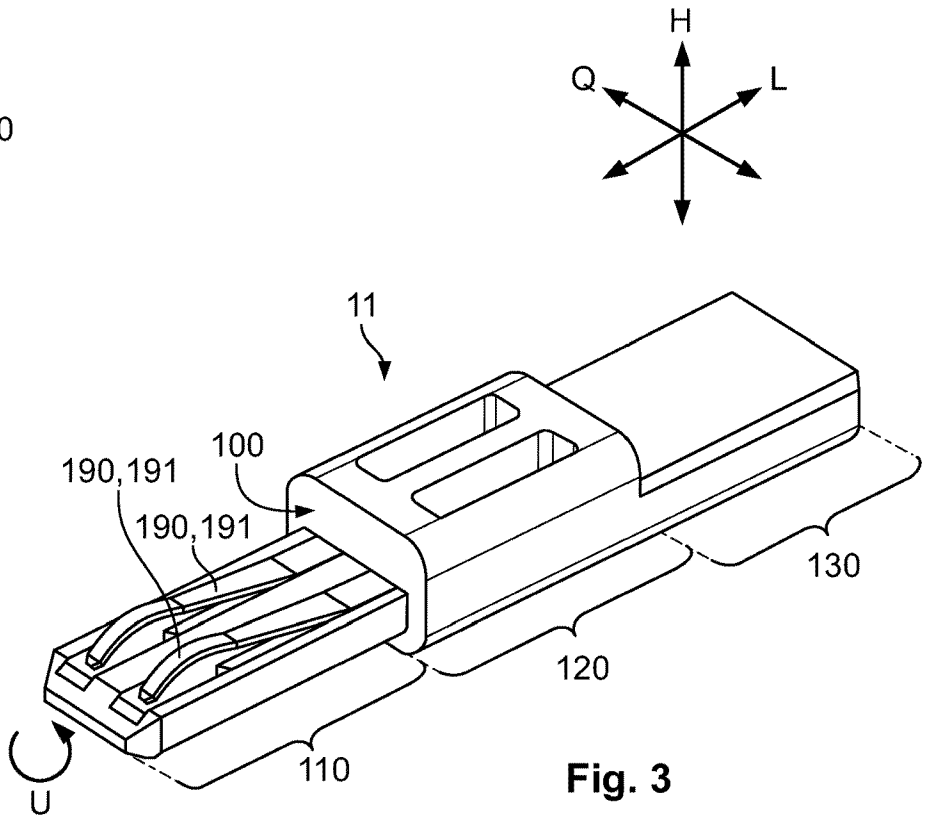
FIG. 3 is a perspective view of a crimpable contact carrier according to an embodiment of the invention.
Figure 4B:
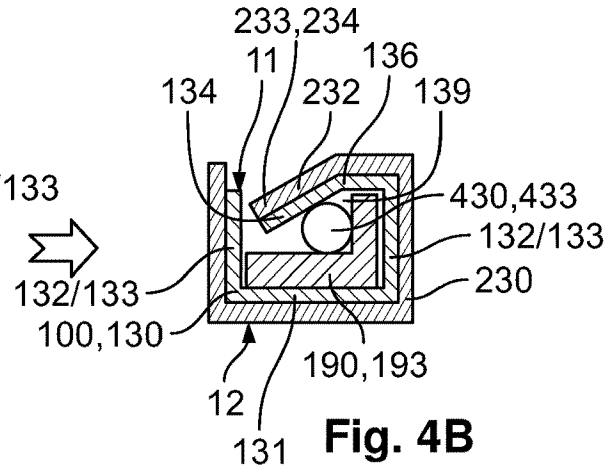
FIG. 4B is a schematic front view of the contact chamber of FIG. 4A with the top wall in a crimped state.
Figure 4A:
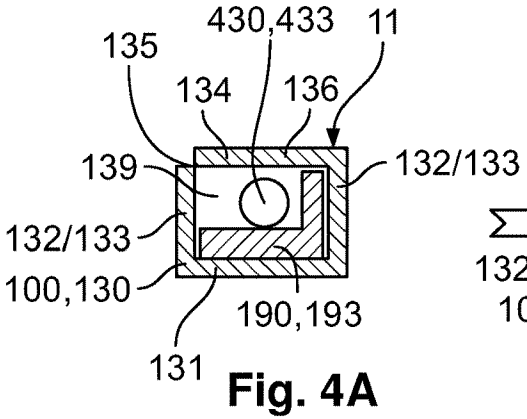
FIG. 4A is a schematic front view of a contact chamber of the contact carrier of FIG. 3 with a top wall in a pre-crimped state.
Figure 5B:
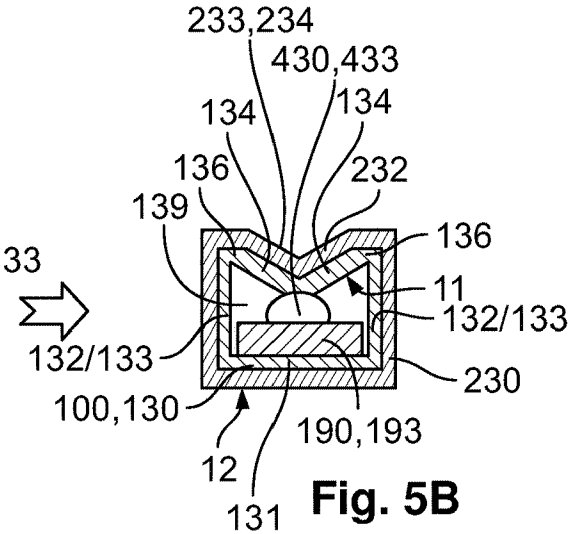
FIG. 5B is a schematic front view of the contact chamber of FIG. 5A with the top wall in a crimped state.

A crimpable contact carrier 11 of the crimp contact unit 10 according to an embodiment is shown in FIGS. 3-5. The contact carrier 11 has a contact carrier body 100 including an inner conductor clamping section 130 instead of a conductor mounting section 180. The inner conductor clamping section 130 has at least one contact chamber 139 as shown in FIGS. 4A-5B. In an embodiment, two side-by-side contact chambers 139 form the inner conductor clamping section 130. The inner conductor clamping section 130 or the contact chambers 139 are formed substantially closed in the circumferential direction U of the contact carrier 11 along the longitudinal direction L of the contact carrier 11 and.

One individual contact chamber 139, as shown in FIGS. 4A-5B, has on a base 131 a completely closed base wall 131, on a side 132 or middle side 133 a completely closed side wall 132 or completely closed middle side wall 133, and on a ceiling 134 a top wall 134. The top wall 134 is formed across at least one integral hinge 136 with at least one side wall 132 and/or at least one middle side wall 133. The top wall 134 can be completely closed, as shown in the embodiment of FIGS. 3 and 5A, or partially closed, as shown in the embodiment of FIG. 4A.

In an embodiment, the contact carrier 11, including the top wall 134, is monolithically formed in a single piece. A materially one-piece contact carrier 11 is intended to be understood to mean a contact carrier 11 which cannot be separated without damaging the contact carrier 11. In an embodiment, the contact carrier 11 is formed by injection molding. In an embodiment, the contact carrier 11 is formed from a plastic material.

Figure 5A:
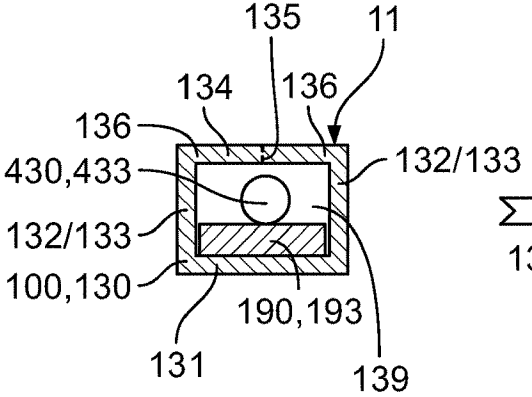
FIG. 5A is a schematic front view of a contact chamber of the contact carrier of FIG. 3 with a top wall in a pre-crimped state.

If the top wall 134 is completely closed, the top wall 134 has a predetermined breaking point 135 as shown in FIG. 5A which extends substantially completely in the longitudinal direction L of the contact chamber 139. The breaking portion 135 can be disposed laterally on a side wall 132 or middle side wall 133 or centrally as shown in FIG. 5. If the top wall 134 is partially closed, as shown in FIG. 4A, the top wall 134 has a through-slot 135 which extends substantially completely in the longitudinal direction L of the contact chamber 139. The through-slot 135 can be disposed laterally on a side wall 132 or middle side wall 133 as shown in FIG. 4A or centrally.

Depending on a configuration of the top wall 134, the top wall 134 can be formed as an individual wing 134 with a lateral through-slot 135 as shown in FIG. 4A, as an individual breached wing 134 with a lateral predetermined breaking point 135, as double breached wings 134 with a middle predetermined breaking point 135 as shown in FIG. 5A, or as double wings 134 with a middle through-slot 135. Depending on a configuration of the top wall 134, a wing with its lateral or middle free edge may be broken free and is movable in the contact chamber 139 with respect to an integral hinge 136. The chamber 139 is thus deformable as the top wall 134 is movable with respect to the integral hinge 136. As shown in FIGS. 4B and 5B, a longitudinal end section 433 of the inner conductor 430 can be mechanically clamped onto a respective cable contact section 193 of the respective contact element 190 by the top wall 134.

The contact chamber 139 or the top wall 134 is deformable or movable by an inner conductor crimping section 230 of a shield contact device 12 as shown in FIGS. 4A-5B and 8. The contact carrier 11 is disposed in the shield contact device 12 and the longitudinal end sections 433 of the inner conductor 430 are positioned in the inner conductor clamping section 130 of the contact carrier 11.

Figure 8:
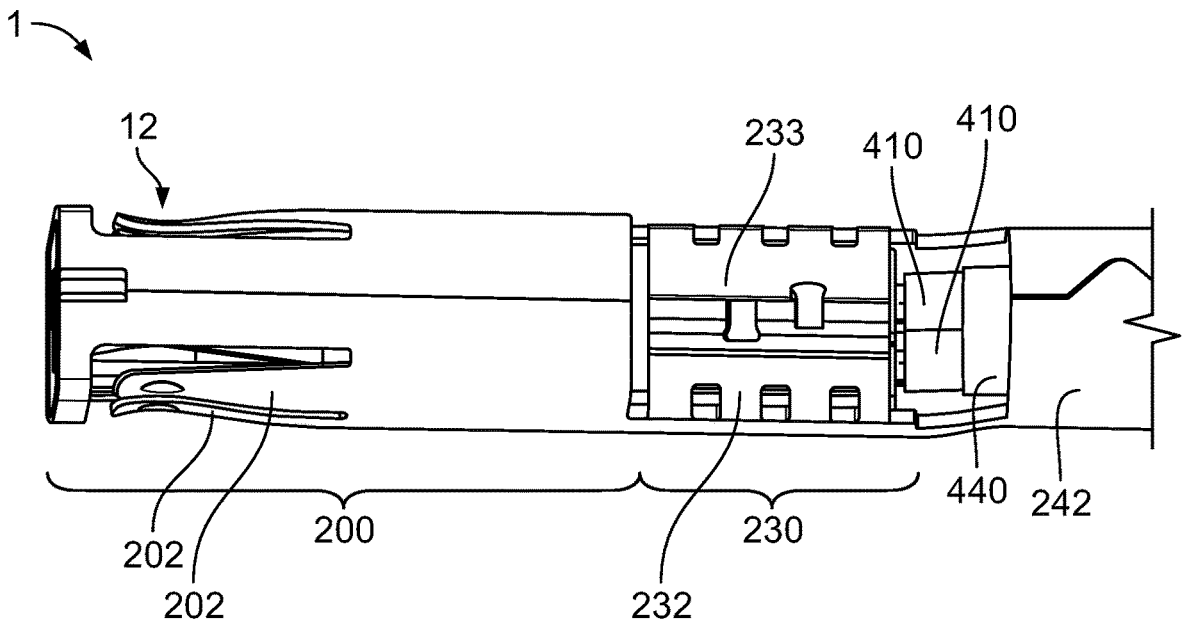
FIG. 8 is a perspective view of an electrical cable assembly according to an embodiment.
Figure 10:
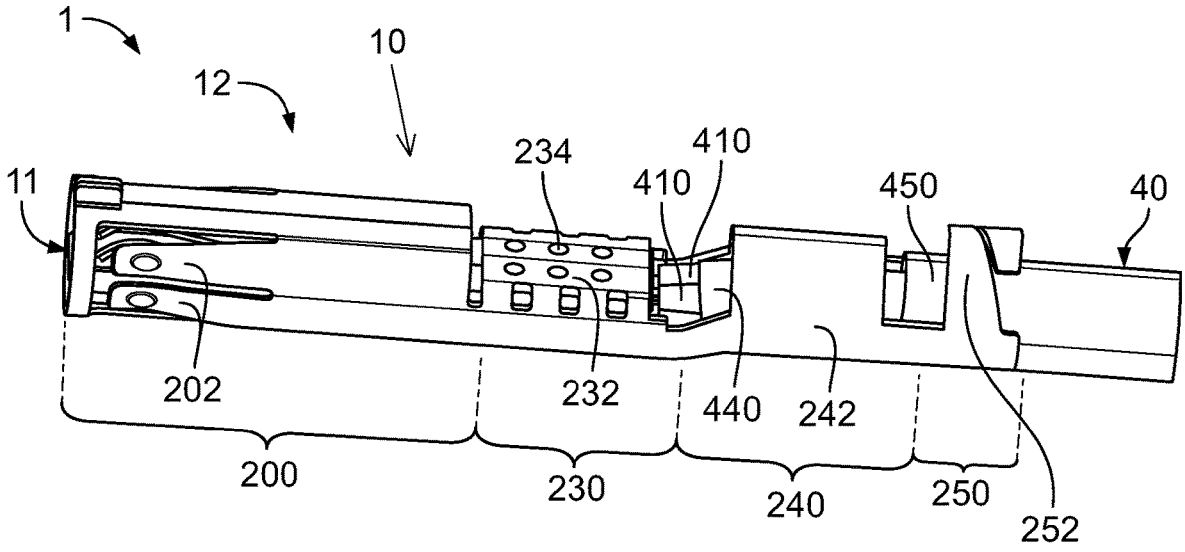
FIG. 10 is perspective view of an electrical cable assembly according to an embodiment.

As shown in FIGS. 8 and 10, the connecting section 110 and the positioning section 120 are positioned in the contact carrier receptacle 200 of the shield contact device 12. The contact carrier 11 and the shield contact device 12 together form a contact unit 10. The conductor clamping section 130 is positioned in an inner conductor crimping section 230 of the shield contact device 12. The inner conductor crimping section 230 has two crimp terminals 232. The shield contact device 12 also has the shield crimping section 240 with two crimp terminals 242 and the insulation crimping section 250 with two crimp terminals 252.

To position the longitudinal end sections 433 of the inner conductors 430 in the inner conductor clamping section 130, the longitudinal end sections 433 of the inner conductors 430 must be advanced from behind into the contact chambers 139 substantially linearly in the longitudinal direction L of the contact carrier 11 and the shield contact device 12. The longitudinal end sections 433 of the inner conductors 430 can then be mechanically clamped onto the cable contact sections of the contact element 190 by crimping.

During crimping, the crimping sections 230, 240, 250 of the shield contact device 12 are substantially simultaneously or partially successively crimped. The inner conductor crimping section 230 of the contact device 12 is crimped onto the conductor clamping section 130 of the contact carrier 11, the shield crimping section 240 of the contact device 12 is crimped onto an electrical outer conductor 440 and/or a ferrule 400 of the outer conductor 440 of the coaxial cable 40, and the insulation crimping section 250 of the contact device 12 is crimped onto an electrical outer insulation of the coaxial cable 40.

The two-pole contact unit 10 with a two-pole coaxial cable 40 crimped thereon forms an electrical cable assembly 1 as shown in FIG. 10. The crimp contact unit 10 is a straight plug-in sleeve. In other embodiments, the crimp contact unit 10 can be formed in an angled or curved manner, or can be a flat plug-in sleeve, a flat plug, a hermaphrodite contact unit, socket contact unit, tab contact unit, peg contact unit, or pin contact unit etc., with one or a plurality of poles.

Figure 6:
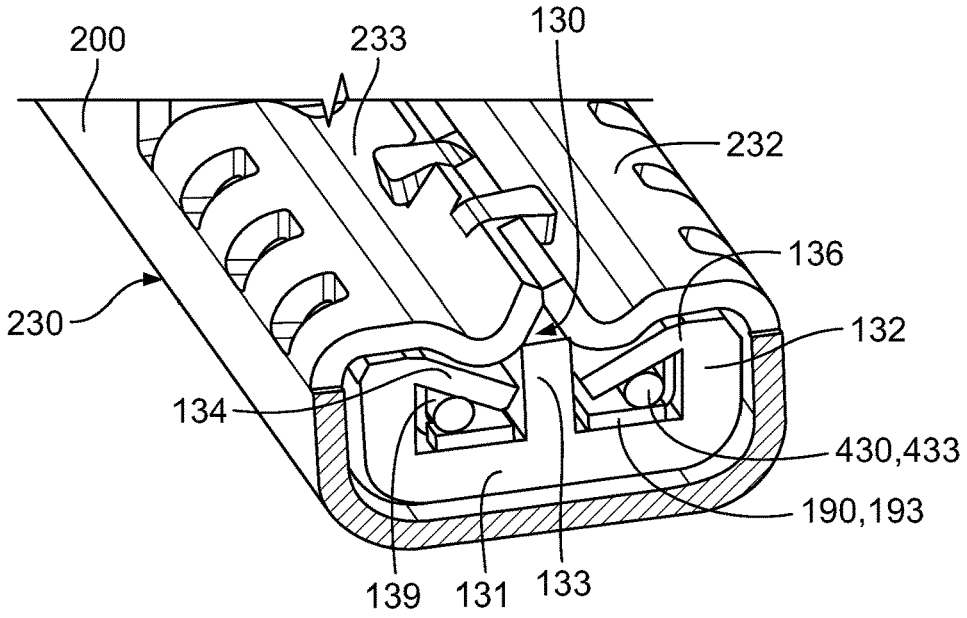
FIG. 6 is a sectional perspective view of a contact carrier and a crimped shield contact device according to an embodiment.
Figure 9:
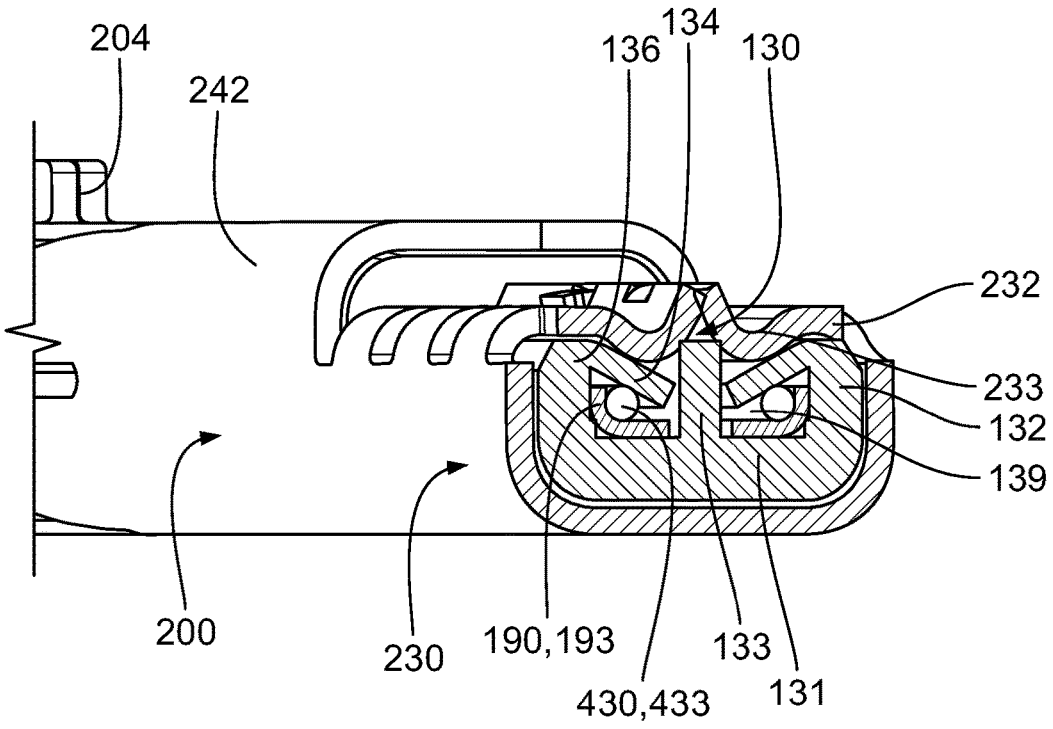
FIG. 9 is a sectional perspective view of a contact carrier and a crimped shield contact device according to an embodiment.

When crimping the inner conductor crimping section 230 of the contact device 12 onto the conductor clamping section 130 of the contact carrier 11, the at least one crimp terminal 232 is moved onto the respective top wall 134 such that the top wall 134 begins to move and breaks the predetermined breaking point 135. The wing, as shown in FIGS. 4B, 6 and 9, or the two wings, as shown in FIGS. 5B, 7, 11 and 13-16, of the top wall 134 are bent inwardly into the respective contact chamber 139, where the free edge thereof or the free edges thereof meet on the longitudinal end section 433 of the respective inner conductor 430. As a result, a crimping connection, clamping connection, press connection, tension connection or squeeze connection etc. is established between the top wall 134, the longitudinal end section 433 of the respective inner conductor 430 and the respective cable contact section 193 of the contact element 190 by the conductor crimping section 230 of the contact device 12 or an at least one crimp terminal 232.

In an embodiment, in order for the respective crimp terminal 232 to be able to actuate the top wall 134 or the wing or wings, the crimp terminal 232 can have at least one inwardly facing projection 233, 234 as shown in FIGS. 4 and 5. The at least one inwardly facing projection 233, 234 of the crimp terminal 232 can be formed from a wall of the crimp terminal 232 itself, for example, by a corrugation 233 as described below, a thickening of a wall of the crimp terminal 232, or at least one impression in a wall of the crimp terminal 232, for example, a dimple 234 as described below. A corrugation 233 is shown in FIGS. 6, 8, 9 and 16 and a dimple 234 is shown in FIGS. 7, 10, 11 and 13-15.

The cable contact section 193 of the respective contact element 190 can be configured such that the longitudinal end section 433 of the respective inner conductor 430 is well clamped. In an embodiment, the respective cable contact section 193 can have a rounded corner region as described in greater detail below with reference to FIGS. 6-16.

In an embodiment, it is possible to fix two crimp terminals 232, 232 to each other, which are opposite each other in a conductor crimping section 230, by a wedge or a dovetail joint. This mechanical connection can also be set in place using a laser welding 235. In another embodiment, instead of a wedge or a dovetail joint, a laser welding 235 can be applied to the two crimp terminals 232, 232.

Additional embodiments will now be described with reference to one individual contact chamber 139 shown in FIGS. 6-16. As described above and shown in FIGS. 6-16, the contact carrier 11 has two side-by-side contact chambers 139 in an embodiment in which the cable 40 is a two-pole coaxial cable 40; the same description applies to each of the contact chambers 139.

In the embodiment shown in FIG. 6, the top wall or wing 134, a cable contact section 193 which is I-shaped in cross-section, and the longitudinal end section 433 of the respective inner conductor 430 are in the contact chamber 139 and crimped laterally onto the cable contact section 193 via a crimp terminal 232 by the wing 134. The crimp terminals 232, 232, which each have a corrugation 233, are connected by a wedge.

Figure 7:
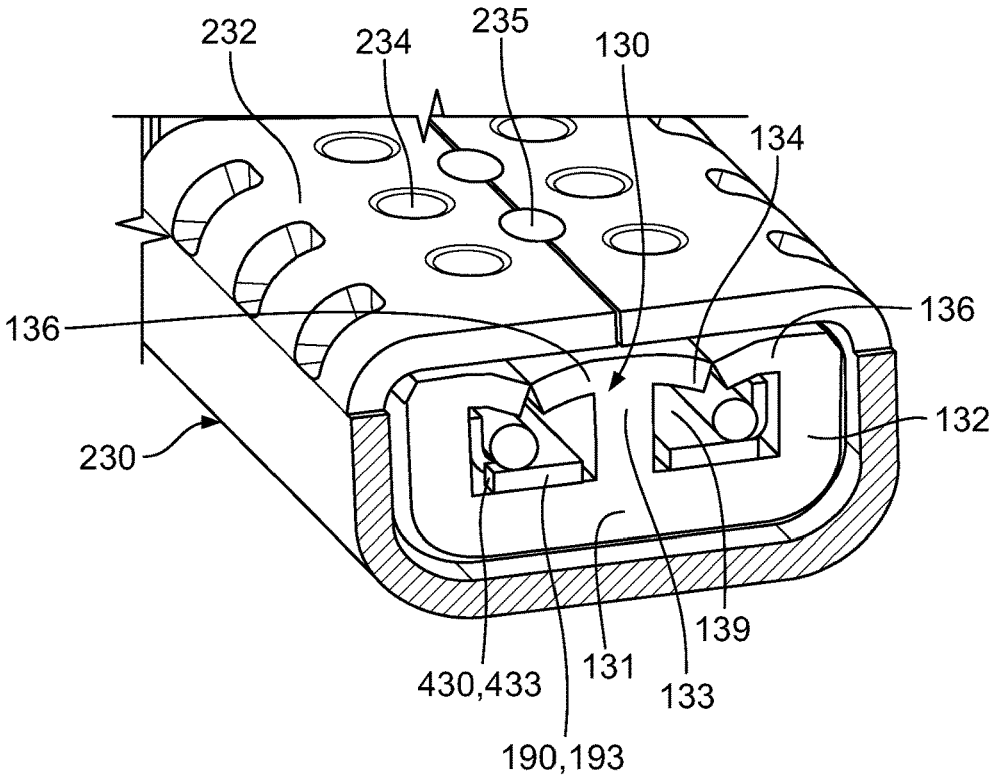
FIG. 7 is a sectional perspective view of a contact carrier and a crimped shield contact device according to an embodiment.

In the embodiment of FIG. 7, the top wall or double wing 134, a cable contact section 193 which is I-shaped in cross-section, and the longitudinal end section 433 of the respective inner conductor 430 are in the contact chamber 139 and crimped laterally onto the cable contact section 193 via a crimp terminal 232 by the double wing 134. The crimp terminals 232, 232, which each have dimples 234, are mechanically connected by a laser welding 235.

In the embodiment of FIGS. 8 and 9, the top wall or wing 134, a cable contact section 193 which is L-shaped in cross-section, and the longitudinal end section 433 of the respective inner conductor 430 are in the contact chamber 139 and crimped onto an inner, rounded corner region of the cable contact section 193 via a crimp terminal 232 by the wing 134. The crimp terminals 232, 232, which each have a corrugation 233, are mechanically connected by a wedge.

Figure 11:
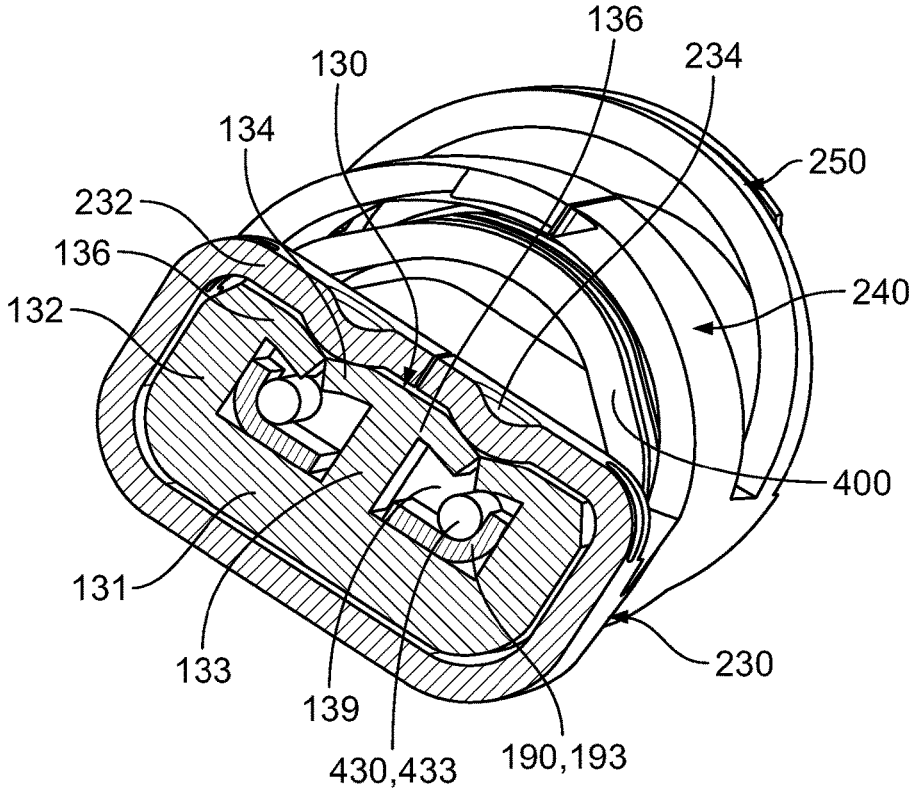
FIG. 11 is a sectional perspective view of the electrical cable assembly of FIG. 10.

In the embodiment of FIGS. 10 and 11, the top wall or double wing 134, a cable contact section 193 which is L-shaped in cross-section, and the longitudinal end section 433 of the respective inner conductor 430 are in the contact chamber 139 and crimped onto the inner, rounded corner region of the cable contact section 193 via a crimp terminal 232 by the double wing 134. The crimp terminals 232, 232, which each have dimples 234, are mechanically connected by a laser welding 235.

Figure 12:
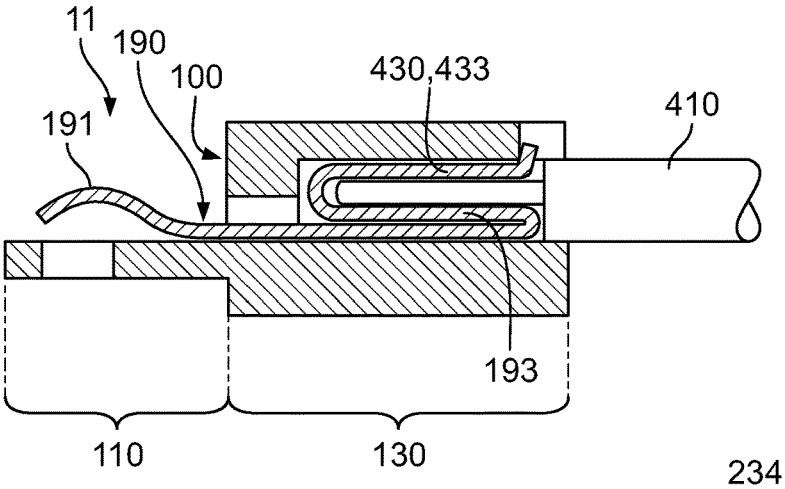
FIG. 12 is a sectional side view of a contact carrier and a contact element according to an embodiment.
Figure 13:
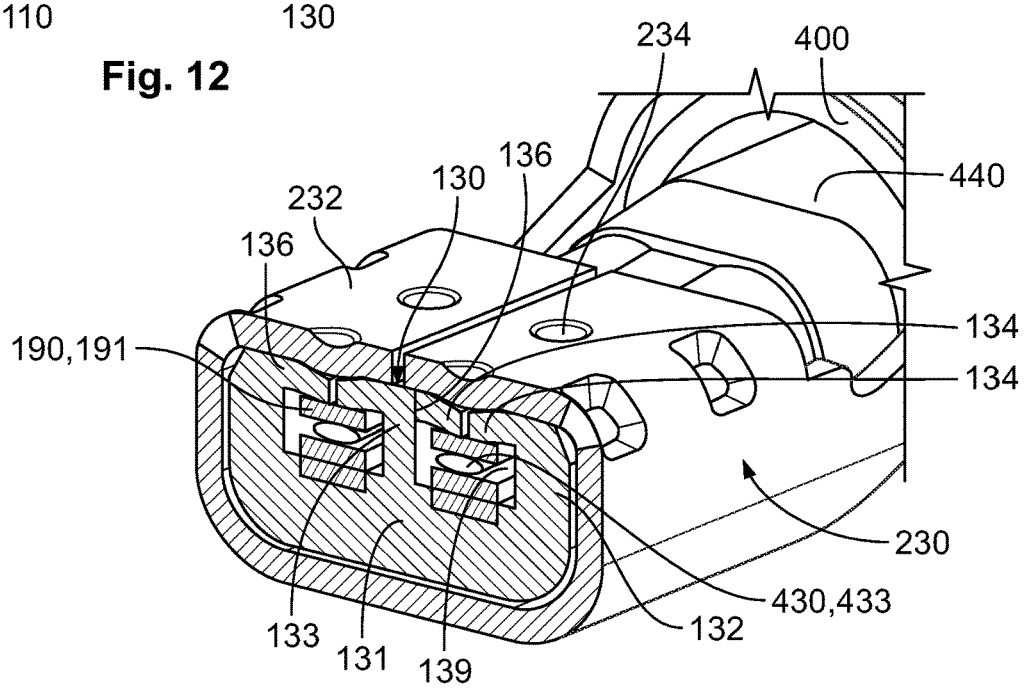
FIG. 13 is a sectional perspective view of the contact carrier of FIG. 12 and a crimped shield contact device.
Figure 14:
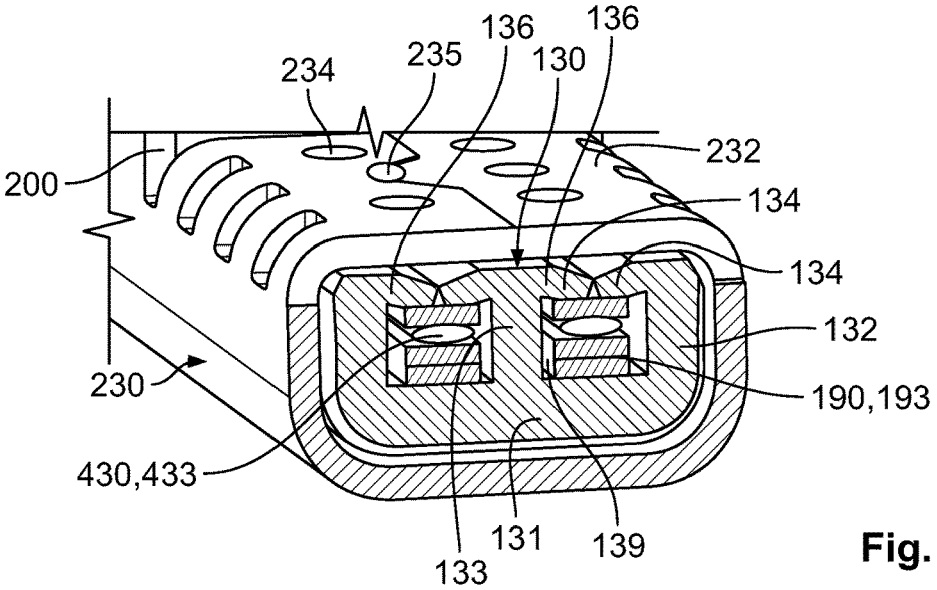
FIG. 14 is a sectional perspective view of a contact carrier and a crimped shield contact device according to an embodiment.

In the embodiment of FIGS. 12-14, the top wall or double wing 134, a cable contact section 193 which is I-shaped in cross-section and substantially S-shaped in the longitudinal direction, and the longitudinal end section 433 of the respective inner conductor 430 are in the contact chamber 139. The longitudinal end section 433 of the respective inner conductor 430 is positioned between two longitudinal sections of the cable contact section 193 which are arranged superimposed in a substantially parallel manner. The longitudinal end section 433 of the respective inner conductor 430 is clamped between the two longitudinal sections of the cable contact section 193 via a crimp terminal 232 by the double wing 134. The crimp terminals 232, 232, which each have dimples 234, are mechanically connected by a laser welding 235. Further, as shown in FIG. 14, the two circumferential edge sections of the crimp terminals 232, 232 are latched. In another variation shown in FIG. 13, it is possible to dispense with the laser welding 235.

Figure 15:
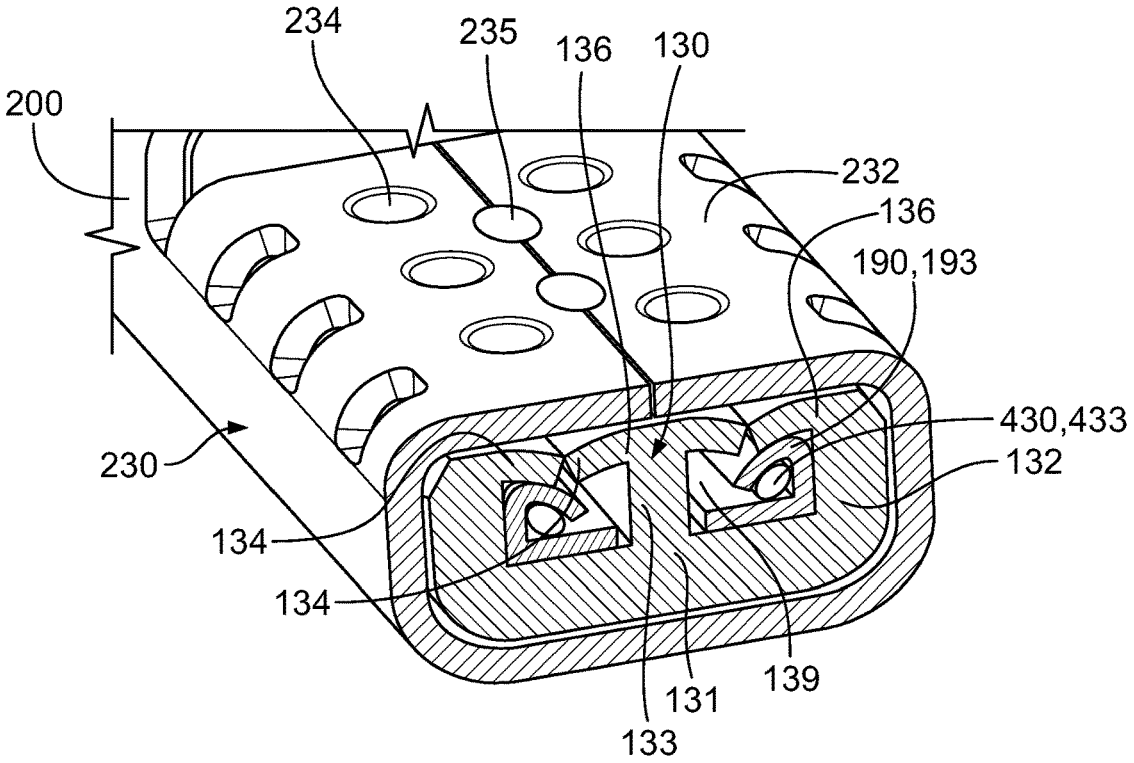
FIG. 15 is a sectional perspective view of a contact carrier and a crimped shield contact device according to an embodiment.
Figure 16:
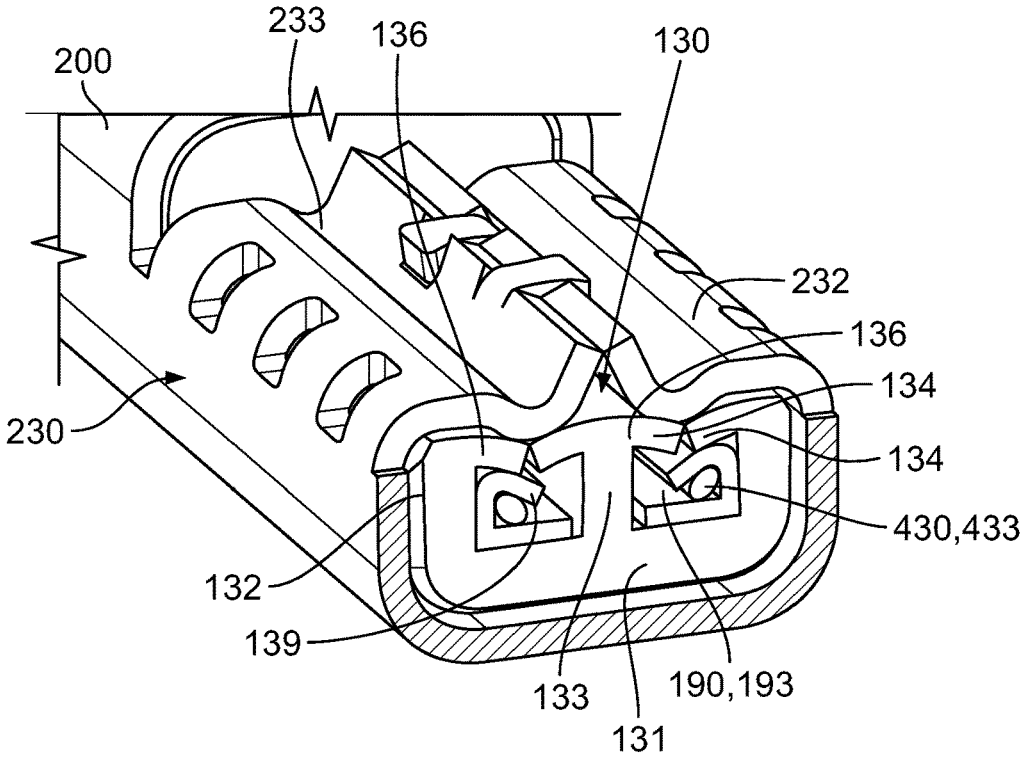
FIG. 16 is a sectional perspective view of a contact carrier and a crimped shield contact device according to an embodiment.

In the embodiment of FIGS. 15 and 16, the top wall or double wing 134, a cable contact section 193 which is U-shaped in cross-section, and the longitudinal end section 433 of the respective inner conductor 430 are in the contact chamber 139. A longitudinal end section of a first limb of the U-shaped cable contact section 193 is crimped by a wing of the double wing 134 onto the longitudinal end section 433 of the respective inner conductor 430. The longitudinal end section 433 is further crimped to a longitudinal end section and a corner region of a second limb of the U-shaped cable contact section 193 opposite the first limb in the vertical direction H.

In the embodiment of FIGS. 15 and 16, a double wing 134, a cable contact section 193 which is U-shaped in cross-section, and the longitudinal end section 433 of the respective inner conductor 430 are in the contact chamber 139. A longitudinal end section of a first limb of the U-shaped cable contact section 193 is crimped by a wing of the double wing 134 onto the longitudinal end section 433 of the respective inner conductor 430. The longitudinal end section 433 is further crimped to a longitudinal end section and a corner region of a second limb of the U-shaped cable contact section 193 opposite the first limb in the vertical direction H.

A substantially three-stage method of producing a two-pole coaxial cable 40 with a contact unit 10 will now be described in greater detail with reference to FIGS. 4 and 5.

In Step I, the coaxial cable 40 is prepared by mounting of a ferrule 400. Step I includes up to four or more substeps and a prefabricated coaxial cable 40 is obtained at the end of Step I.

Figure 2:
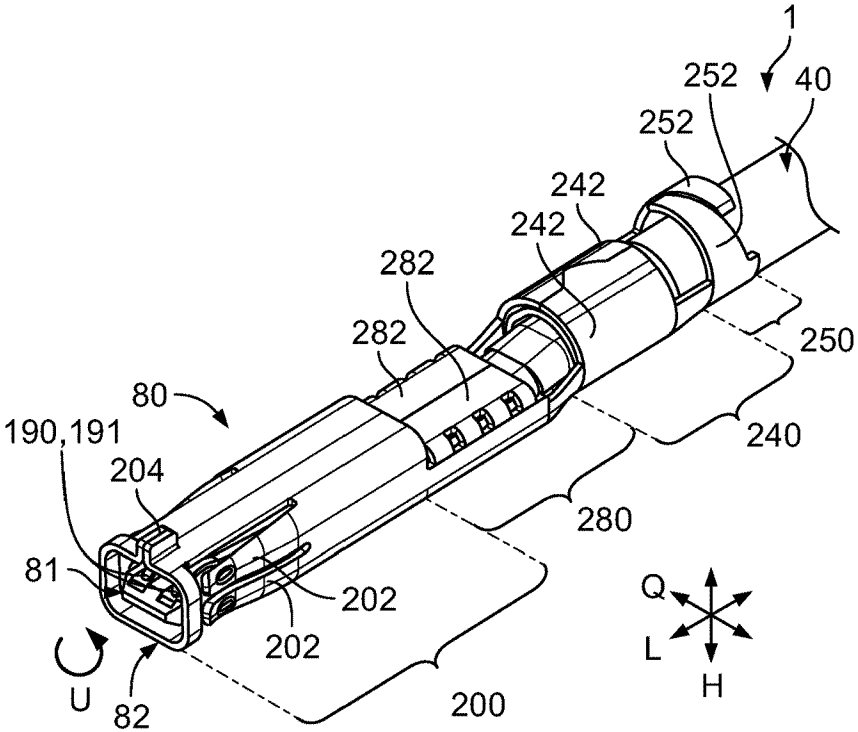
Fig. 2 PRIOR ART
FIG. 2 is a perspective view of an electrical cable assembly according to the prior art with the electrical contact unit and the coaxial cable of FIG. 1.

In Substep I.1, the coaxial cable 40 is stripped from an outer insulation 450 at its free longitudinal end section and thus a longitudinal end section 443 of the outer conductor 440 of the coaxial cable 40 is exposed as shown in FIG. 1.

In a Substep I.2, the ferrule 400 shown in FIG. 1 is then fastened to a rear section of the longitudinal end section 443 of the exposed outer conductor 440. The rear section of the longitudinal end section 443 of the exposed outer conductor 440 is inserted into the ferrule 400, which is located on a carrier strip, and is then crimped thereon. Subsequently, the ferrule 400 is separated from the carrier strip.

In another embodiment, the ferrule 400 is first separated from the carrier strip, then the ferrule 200 is moved onto the rear section of the longitudinal end section 443 of the exposed outer conductor 440 and crimped thereon. The rear section of the longitudinal end section 443 of the exposed outer conductor 440 and the ferrule 400 may also be moved towards each other.

The ferrule 400 is plastically deformable and integrally formed. The ferrule 400 is open and has two crimping flanks prior to mounting on the coaxial cable 40. Each crimping flank of the ferrule 400 has a circumferential edge section. The two circumferential edge sections are formed substantially complementary or substantially in a form-fitting manner with each other such that an enclosure is formed in a light-tight manner between the crimping flanks of the mounted ferrule 400 in the longitudinal direction L.

In a Substep I.3, a free section of the outer conductor 440 is disposed outside of the ferrule 400. In an embodiment in which the Substep I.3 is omitted, it is obligatory to make the ferrule 400 from an electrically conductive material. In another embodiment, a free end of the outer conductor 440 substantially coincides with a free end of the ferrule 400 in the longitudinal direction L.

In a Substep I.4, a free longitudinal end section of an electrical inner insulation 410 of the coaxial cable 40, which protrudes at the free end of the outer conductor 440, is stripped. Subsequently, two free longitudinal end sections 433 of two inner conductors 430 protrude from the coaxial cable 40 as shown in FIG. 1. In this Substep I.4, the inner conductors 430 are freed from the inner insulation 410, except for one comparatively short rear section.

In Step II, the free longitudinal end sections 433 of the two inner conductors 430 are positioned in the two contact chambers 139 of the conductor clamping section 130 of the contact carrier 11 and are linearly advanced therein. The contact carrier 11 is already disposed in the shield contact device 12, which has not yet been crimped. In another embodiment, the inner conductors 430 are initially disposed in the two contact chambers 139 and subsequently provide the contact carrier 11 together with the coaxial cable 40 in the shield contact device 12 which has not yet been crimped. The crimp contact unit 10 including the contact carrier 11 and the contact shield device 12 is then ready to be crimped.

In Step III, a single crimp action is carried out which connects the coaxial cable 40 in an electrically conductive and mechanically fixed manner to the contact carrier 11 and also in an electrically conductive and mechanically fixed manner to the shield contact device 12. Three crimps, including an inner conductor crimp, an outer conductor crimp and an insulation crimp, are established substantially simultaneously as described above. When carrying out the crimp method, the contact device 12 can still be located on a carrier strip 290 shown in FIG. 1 or may already have been separated from the carrier strip 290.

In other embodiments, the elements described above can be applied to all contact carriers, crimp contact units and production methods of cable assemblies. Embodiments including the features described herein can be applied anywhere that crimp connections are to be produced or established, including in applications beyond the automotive industry and beyond coaxial cables.

What is claimed is:

1. A contact carrier for an electrical contact device, comprising:

a contact carrier body having a connecting section and a conductor clamping section, the conductor clamping section substantially closed in a circumferential direction of the contact carrier body and extending along a longitudinal direction of the contact carrier body, the conductor clamping section has a top wall on a side of a contact chamber, the top wall having an integral hinge extending in the longitudinal direction of the contract carrier body and is deformable along the integral hinge in the longitudinal direction and into the contact chamber, the top wall including a predetermined breaking point extending in the longitudinal direction of the contract carrier body or a through-slot extending in the longitudinal direction of the contact carrier body for deformable displacement of the top wall; and a contact element disposed in the contact carrier body, the contact element having a contact section extending from the connecting section for contacting a mating contact element.

2. The contact carrier of claim 1, wherein a longitudinal end section of a conductor of a cable is clamped onto a cable contact section of the contact element by deformation of the contact chamber.

3. The contact carrier of claim 2, wherein the top wall of the conductor clamping section is deformable to clamp the longitudinal end section of the conductor directly or indirectly onto the cable contact section.

4. The contact carrier of claim 3, wherein the predetermined breaking point or the through-slot is disposed at a center of the top wall and the top wall has a pair of deformable wings on opposite sides of the predetermined breaking point or through-slot.

5. The contact carrier of claim 3, wherein the predetermined breaking point or the through-slot is disposed on a lateral end of the top wall and the top wall is formed as an individual deformable wing.

6. The contact carrier of claim 1, wherein the top wall is displaced at the predetermined breaking point or directly adjacent to the through-slot into the contact chamber in response to the deformation of the top wall in the longitudinal direction along the integral hinge.

7. An electrical contact unit, comprising:

a shield contact device having a contact carrier receptacle and a conductor crimping section; and a contact carrier disposed in the contact carrier receptacle and having a conductor clamping section deformable by crimping of the conductor crimping section, the conductor clamping section has a top wall on a side of a contact chamber, the top wall having a first side facing the contact chamber and a second side opposite the first side, the top wall having an integral hinge extending in the longitudinal direction of the contract carrier and being deformable along the integral hinge in the longitudinal direction and into the contact chamber by an inwardly facing projection of a crimp terminal of the conductor crimping section contacting the second side of the top wall in a direction of the contact chamber during crimping.

8. The electrical contact unit of claim 7, wherein the contact carrier insulates a longitudinal end section of a conductor of a cable from the shield contact device.

9. The electrical contact unit of claim 7, wherein a longitudinal end section of a conductor of a cable is clamped onto a cable contact section of a contact element disposed in the contact carrier by the conductor clamping section.

10. The electrical contact unit of claim 9, wherein the conductor is an inner conductor of the cable.

11. The electrical contact unit of claim 7, wherein the longitudinal end section of the conductor is clamped onto the cable contact section by the top wall when the top wall is deformed.

12. The electrical contact unit of claim 7, wherein the inwardly facing projection is formed at the crimp terminal during crimping.

13. A method of producing an electrical cable assembly, comprising:

providing a shield contact device having a contact carrier receptacle and a contact carrier having a contact element, the contact carrier disposed in the contact carrier receptacle and having a conductor clamping section deformable by crimping, the conductor clamping section has a top wall on a side of a contact chamber, the top wall having an integral hinge extending in a longitudinal direction of the contact carrier and is deformable along the integral hinge in the longitudinal direction and into the contact chamber; and crimping a conductor crimping section of the shield contact device onto a surface of the top wall of the conductor clamping section opposite the contact chamber to establish an electrically conductive and mechanically fixed connection between a cable contact section of the contact element and a longitudinal end section of an electrical conductor of a cable.

14. The method of claim 13, wherein the longitudinal end section of the conductor is clamped onto the cable contact section by the top wall of the conductor clamping section.

15. The method of claim 14, wherein the longitudinal end section of the conductor and the cable contact section are insulated from the shield contact device.

16. An electrical cable assembly, comprising:

a cable;

a shield contact device having a contact carrier receptacle and a conductor crimping section; and a contact carrier disposed in the contact carrier receptacle and having a conductor clamping section deformable by crimping of the conductor crimping section and clamping a conductor of the cable onto a cable contact section of a contact element disposed in the contact carrier, the conductor clamping section has a top wall on a side of a contact chamber, the top wall having an integral hinge extending in a longitudinal direction of the conductor of the cable such that a free end of the top wall extending in the longitudinal direction of the conductor of the cable is deformable along the integral hinge in the longitudinal direction and into the contact chamber.

17. The electrical cable assembly of claim 16, wherein the top wall comprises a first side facing the contact chamber and a second side opposite the first side, the top wall being deformable into the contact chamber by the conductor crimping section acting on the second side of the top wall in a direction of the contact chamber.

* * * * *